US008089999B2

(12) United States Patent
Manasek

(10) Patent No.: US 8,089,999 B2
(45) Date of Patent: Jan. 3, 2012

(54) HEAT EXCHANGE APPARATUS AND METHOD OF USE

(75) Inventor: Richard J. Manasek, Greenwood, IN (US)

(73) Assignee: AmeriFab, Inc., Indianapolis, IN (US)

( * ) Notice: Subject to any disclaimer, the term of this patent is extended or adjusted under 35 U.S.C. 154(b) by 141 days.

(21) Appl. No.: 11/813,076

(22) PCT Filed: Nov. 1, 2006

(86) PCT No.: PCT/US2006/060461

§ 371 (c)(1), (2), (4) Date: Jun. 28, 2007

(87) PCT Pub. No.: WO2007/100386

PCT Pub. Date: Sep. 7, 2007

(65) Prior Publication Data

US 2009/0151916 A1 Jun. 18, 2009

Related U.S. Application Data

(60) Provisional application No. 60/732,618, filed on Nov. 1, 2005.

(51) Int. Cl.

| | |
|---|---|
| ***F27D 1/12*** | (2006.01) |
| ***F27D 1/00*** | (2006.01) |
| ***F28D 7/02*** | (2006.01) |
| ***F28F 3/14*** | (2006.01) |
| ***F28F 1/10*** | (2006.01) |
| ***F22B 15/00*** | (2006.01) |
| ***C21B 7/10*** | (2006.01) |

(52) U.S. Cl. ..... 373/76; 373/71; 373/75; 165/165; 165/170; 165/171; 122/235.12; 432/238; 266/193; 266/194

(58) Field of Classification Search ..... 373/71, 373/72, 76, 75; 165/168, 178, 170, 171, 165/172; 266/47, 241, 194, 193; 432/233, 432/238, 248; 122/235.12, 512, DIG. 13
See application file for complete search history.

(56) References Cited

U.S. PATENT DOCUMENTS

| | | | | | |
|---|---|---|---|---|---|
| 1,732,514 | A | * | 10/1929 | Hunter | 165/169 |
| 1,844,407 | A | * | 2/1932 | Murray et al. | 165/183 |
| 2,149,008 | A | * | 2/1939 | Chapman et al. | 165/171 |
| 4,033,561 | A | | 7/1977 | Dhelft | |
| 4,135,575 | A | * | 1/1979 | Gersch | 373/76 |

(Continued)

FOREIGN PATENT DOCUMENTS

DE 299 04 559 6/1999

(Continued)

OTHER PUBLICATIONS

The Riverside Publishing Company; New Riverside University Dictionary; Copyright 1984, 1988, 1994; Cover, Inside Cover, pp. 703 and 969.

(Continued)

*Primary Examiner* — Henry Yuen
*Assistant Examiner* — Hung D Nguyen
(74) *Attorney, Agent, or Firm* — Barnes & Thornburg

(57) ABSTRACT

A pipe and method of use for deterring or encouraging the retention of slag or other material in the operating area of a metal processing system as desired. The deterring pipe(s) and the encouraging pipe(s) may be combined with other deterring pipe(s) and/or other encouraging pipe(s) in any combination as desired.

26 Claims, 3 Drawing Sheets

U.S. PATENT DOCUMENTS

| | | | | |
|---|---|---|---|---|
| 4,455,017 | A * | 6/1984 | Wunsche | 373/76 |
| 4,458,351 | A * | 7/1984 | Richards | 373/76 |
| 6,041,854 | A * | 3/2000 | Fox | 165/168 |
| 6,257,326 | B1 * | 7/2001 | Heinrich | 165/169 |
| 6,330,269 | B1 | 12/2001 | Manasek et al. | |
| 6,890,479 | B2 | 5/2005 | Manasek et al. | |

FOREIGN PATENT DOCUMENTS

| | | |
|---|---|---|
| EP | 75 39662 | 12/1975 |
| EP | 0 905 466 | 3/1999 |
| EP | 01 909 161.0-2122 | 12/2004 |
| EP | 01 909 161.0-2122 | 9/2005 |
| GB | 1064506 | 9/1965 |
| GB | 1088827 | 9/1965 |
| GB | 1 365 514 | 9/1974 |
| GB | 2 377 008 | 12/2002 |
| WO | WO 01/63193 | 8/2001 |

OTHER PUBLICATIONS

Complaint for Patent Infringement, dated Aug. 13, 2004.
Answer and Counterclaims, dated Nov. 29, 2004.
Plaintiff's Reply to Defendant's Counterclaim, dated Dec. 3, 2004.
Declaration of J. V. Guy-Bray, dated Dec. 13, 2004.
Amended Complaint for Patent Infringement, dated Mar. 11, 2005.
Jonathan Midgley of Marks & Clerk; Fax regarding letter and amended pp. 2, 4, 5 and 11 to 13—European Patent Application 01909161.0; Mar. 21, 2005.
Answer to Amended Complaint and Counterclaims, dated Mar. 23, 2005.
Joint Motion for Entry of Stipulated Protective Order, dated Mar. 28, 2005.
Stipulated Protective Order, dated Mar. 30, 2005.
Order on Claim Construction, dated Jul. 29, 2005.
Motion and Answer for Leave to Amend Affirmative Defenses and Counterclaims, dated Aug. 3, 2005.
Answer to Amended Complaint with Amended Affirmative Defenses and Counterclaims, dated Sep. 2, 2005.
Declaration of R. Eric Gaum, dated Sep. 13, 2005.
Plaintiff's Reply to Defendant's Amended Counterclaims, dated Sep. 22, 2005.
Order on Motions for Summary Judgment, dated May 10, 2006.
Defendant's Motion for Partial Reconsideration and/or Clarification of the Court's Summary Judgment Ruling on Patent Invalidity, dated May 26, 2006.
Order on Defendant's Motion for Partial Reconsideration and/or Clarification of the Court's Summary Judgment Rule on Patent Invalidity, dated Jun. 2, 2006.
Stipulated Notice of Dismissal, dated Jan. 11, 2007.
Stipulated Notice of Dismissal Is Granted, dated Jan. 12, 2007.
Patent Cooperation Treaty International Search Report for International Application No. PCT/US06/60461, (date of actual completion of search: Jul. 24, 2008)(date of mailing: Jul. 28, 2008).
Patent Cooperation Treaty Written Opinion of the International Searching Authority for International Application No. PCT/US06/60461, (date of completion of opinion: Jul. 24, 2008)(date of mailing: Jul. 28, 2008).
European Search Report for European Patent Application 06 850 091.7, dated Sep. 8, 2010.

* cited by examiner

HEAT EXCHANGE APPARATUS AND METHOD OF USE

CROSS REFERENCE TO RELATED APPLICATION

This application is a U.S. national counterpart application of international application ser. No. PCT/US2006/060461 filed Nov. 1, 2006, which claims priority to U.S. Provisional Patent Application No. 60/732,618 filed Nov. 1, 2005. The entireties of both of the disclosures are incorporated herein by reference.

FIELD OF THE INVENTION

The present invention relates generally to heat exchange devices, and more specifically to heat exchange devices for use in the processing of metals.

BACKGROUND AND SUMMARY OF THE INVENTION

The steel, foundry and metal refining industry has challenges with water cooled and non-water-cooled equipment operating in high mechanical wear, high corrosive, high temperature, high electrically conductive and thermally stressing environment within the melting furnace. In some process applications, it is advantageous for a foreign substance such as for example slag, which is a by-product of the melting process, to collect on the operating side ("hot side") or operating portion of the equipment to harness the non-conductive and insulating properties of slag in order to protect the equipment from damage, wear and premature failure during operation. The collected or retained slag also protects against the accidental and potential catastrophic effects of inadvertent splashing of liquid metal against the operating side of the equipment caused by excessive boiling or slopping of the molten metal during the melting process. A suitable example of cooling pipes designed to encourage slag retention is found in commonly owned U.S. Pat. No. 6,330,269, the disclosure of which is now expressly incorporated herein by reference.

The steel, foundry and metal refining industry also has challenges with water cooled and non-water-cooled equipment collecting slag and/or other foreign materials on the hot face of the equipment during operation. This slag, siliceous, metallic and/or other foreign materials that enter the process can be detrimental to the operation should it become detached and fall into the liquid steel that is contained within the furnace or duct structure. For example, the accidental intrusion of such material into the molten metal could cause the molten metal in the vessel to become off-specification resulting in its being scrapped or require additional high cost processing to refine the molten metal back to its acceptable composition. The accidental dropping of this material into the furnace could also cause excessive boiling or slopping of the molten metal creating a safety hazard in and around the vessel. In addition, the detaching of the foreign materials can be a safety issue should it fall when the equipment is off-line and either damage equipment or hurt workers in the area.

What is needed is a pipe or series of pipes that either encourage or discourage the retention of slag on operating surfaces as desired.

The present invention may comprise one or more of the features identified in the various claims appended to this application and combinations of such features, as well as one or more of the following features and combinations thereof.

Provided is a heat exchange apparatus comprising:

a pipe having heavy walls defined by an inner boundary and an outer boundary, the pipe including:

a hollow core defined by the inner boundary and having a core center;

a support portion on the outer boundary, the support portion having a support center and a support length defined by a cumulative distance the support portion extends laterally on either side of the support center;

a generally planar conduction portion formed generally tangentially on the outer boundary generally opposite the support portion and extending generally laterally of the pipe, the conduction portion having a conduction center and a conduction length defined by a cumulative distance the conduction portion extends generally laterally on either side of the conduction center, the conduction length being greater than the support length; and;

wherein the pipe has a vertical axis extending generally through the core center when viewed in cross section and wherein each of the support, core and conduction centers are displaced from and generally aligned with one another along the vertical axis; and wherein the support portion is configured to mount the unitary pipe within a metallurgy furnace such that the conduction portion is disposed facing inwardly toward the operating portion of the furnace and the support portion is disposed facing outwardly away from the operating portion of the furnace.

Also provided is a heat exchange apparatus comprising:

- a unitary pipe having heavy walls defined by an inner boundary and an outer boundary, the pipe including:
  - a tubular section,
  - a generally arcuate support portion defined by the outer boundary, and
  - a generally planar conduction portion formed integrally with the outer boundary and generally opposed to the support portion.

Also provided is a method of cooling the interior wall of a metallurgical furnace comprising the steps of:

- providing a panel, the panel including a plurality of unitary pipes, each pipe comprising:
- a tubular section,
- a generally arcuate support portion defined by the outer boundary, and
- a generally planar conduction portion formed integrally with the outer boundary and generally opposed to the support portion;
- wherein each support portion is attached to the plate;
- attaching the panel to the interior of the metallurgical furnace; and
- directing a cooling fluid through the tubular section.

One illustrative embodiment comprises an extruded, drawn or cold rolled tube or pipe that has notches or indentions in its conduction surface to promote the adhesion of slag, siliceous or other foreign materials during normal operations in a metal processing device. A plurality of the illustrative tubes or pipes may be coupled, butted and/or welded together to form a notched surface that promotes adhesion of slag, siliceous or other foreign material.

Another illustrative embodiment comprises an extruded, drawn or cold rolled tube or pipe that has a substantially flat surface configured to deter or resist the adhesion of slag, siliceous or other foreign material during normal operations of a metal processing device, system or equipment. A plurality of the illustrative pipes may be coupled, butted and/or welded together to form a generally smooth planar surface configured to deter or resist the adhesion of slag, siliceous or other foreign material.

Illustratively, any combination and configuration of the notched and the generally smooth-surface pipes may be used as appropriate in the various areas of the metal processing device, system or equipment.

Illustratively, the pipes can be cold rolled, hot rolled, drawn, extruded or cast. The pipes can be manufactured from ferrous metals, steel, copper, steel/ferrous alloy or copper alloys, nickel, titanium, bronze alloys including aluminum-bronze and nickel-bronze alloys, and other suitable materials. The pipes can be seamless or welded in design.

These and other objects of the present invention will become more apparent from the following description of the illustrative embodiment.

DESCRIPTION OF THE ILLUSTRATIVE EMBODIMENTS

Figure 1:
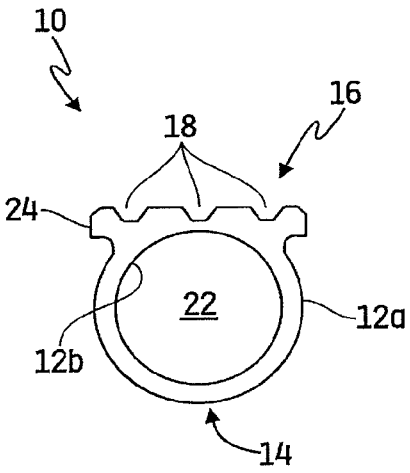
FIG. 1 is a cross-sectional view of an illustrative pipe having a conduction section having a plurality of notches.
Figure 2:
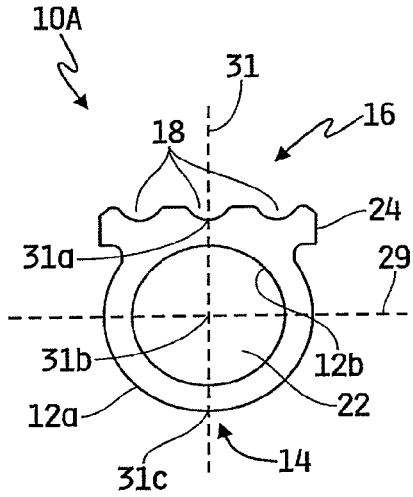
FIG. 2 is a cross-sectional view of the illustrative pipe of FIG. 1 but having thicker walls.
Figure 3:
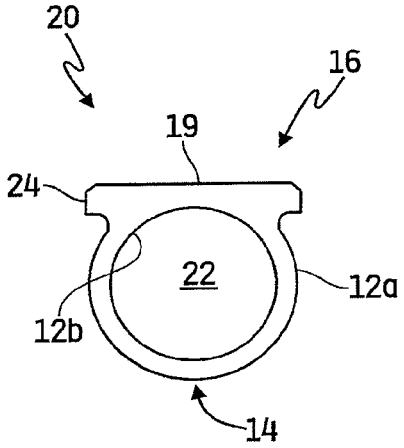
FIG. 3 is a cross-sectional view of an illustrative pipe having a conduction section having a substantially flat surface.
Figure 4:
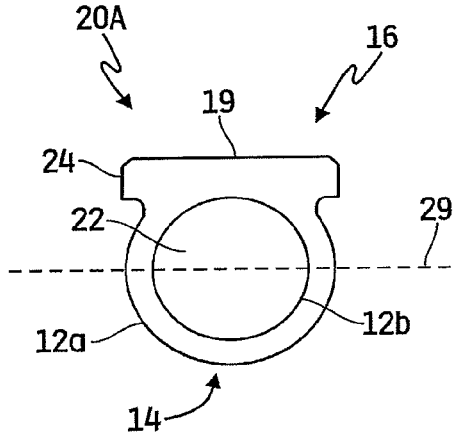
FIG. 4 is a cross-sectional view of the illustrative pipe of FIG. 3 but having thicker walls.

For the purposes of promoting an understanding of the principles of the invention, reference will now be made to a number of illustrative embodiments illustrated in the drawings and specific language will be used to describe the same.

Illustratively, the heat exchange apparatus comprises a pipe 10, 10A, 20, 20A having walls defined by an outer boundary 12*a* and an inner boundary 12*b*, the inner boundary defining a core section 22. The pipe further comprises a support portion 14 and a conduction portion or section 16 which is generally opposite the support portion 14. The hollow core 22 defined by the inner and outer boundaries 12*a*, 12*b* illustratively may generally be a tube or tubular section and has a core center. Illustratively, the support portion 14 is arcuate, although it need not be. For example and without limitation it may be planar, and may even have protrusions formed on the outer boundary 12*a*. The pipe has a vertical axis 31 running generally through the support section center 31*c*, the core center 31*b* and the conduction portion center 31*a*. The conduction portion 16 illustratively is generally tangent to the outer boundary 12*a*, and has protrusions extending generally laterally or horizontally on either side of the conduction center 31*a*. Illustratively, the combined length of the horizontally extending protrusions is greater than the length of any such support section protrusions, if any.

One or more pipes 10, 10A, 20, 20A illustratively may be coupled together with one or more other pipes 10, 10A, 20, 20A in any suitable configuration and combination of pipes 10, 10A, 20, 20A to form a heat exchange apparatus 30, 35, 40. The conduction section 16 illustratively may but need not include protruding ends 24, which may be configured to couple with the protruding ends 24 of adjacent pipes 10, 10A, 20, 20A. The support section 14 may be configured to couple directly with any suitable part, portion or area of a metal processing system, or to couple with a mounting plate (not shown), which in turn may be coupled with the metal processing system, such as for example and without limitation a furnace. For example and without limitation the pipe 10, 10A, 20, 20A may be coupled with or mounted within the operating portion or area of a metal processing apparatus, system, or equipment 25, 25A including attachment to the system's roof, sidewall, duct, burner gland or other equipment or areas required for metallic melting and refining in for example and without limitation an electric arc furnace (EAF), a foundry furnace, a metallurgical furnace, a ladle metallurgy device, and/or a degassing (VAD AOD, etc) device. The pipe is positioned in the equipment between an interior and a wall of the system. In other words, the conduction portion 16 of the pipe is exposed to the hot metal or gases emanating therefrom while the support portion 14 is attached directly to the wall 27, roof or other interior structure of the system or to a plate 26 that is attached to the system. The support portion 14 may be attached or coupled to the system directly, or it may be attached to a mounting plate 26 or other suitable component, which in turn mounts or couples with a wall, roof, or the like 27 of the system such as for example and without limitation an EAF. Thus, the conduction portion 16 is generally positioned so as to be exposed to the internal, operating or working area 25, 25A of the metal processing apparatus, system, or equipment.

Figure 7:
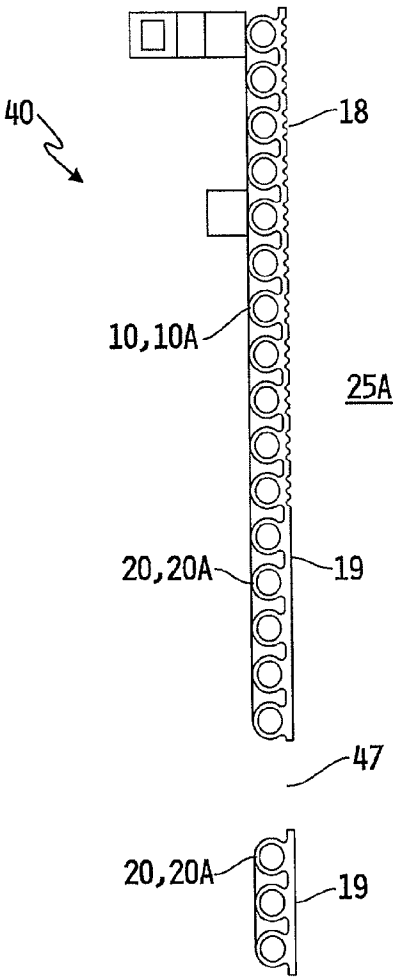
FIG. 7 is a cross-sectional view of an array of illustrative pipes depicted in FIG. 1, FIG. 2, FIG. 3 and/or FIG. 4 illustratively coupled to the inside sidewall of a metal processing device.
Figure 5:
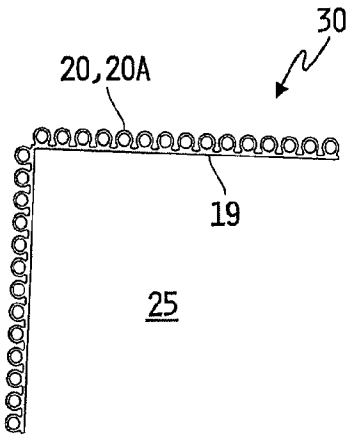
FIG. 5 is a cross-sectional view of an array of illustrative pipes depicted in FIG. 3 or FIG. 4 illustratively coupled to the roof of a metal processing device.
Figure 6:
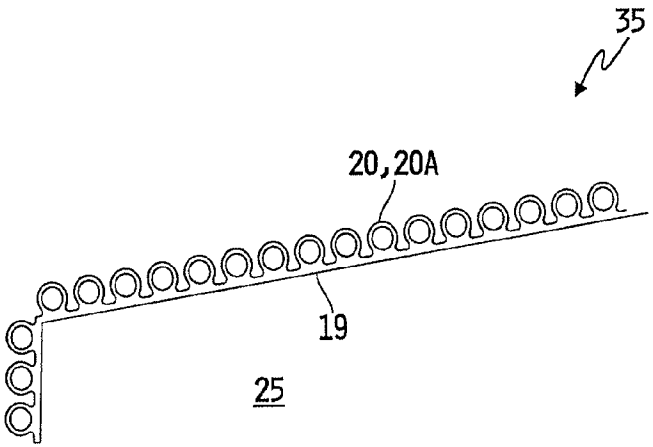
FIG. 6 is a cross-sectional view of an array of illustrative pipes depicted in FIG. 3 or FIG. 4 illustratively coupled to the roof of a metal processing device.

The conduction portion or section 16 may comprise a substantially smooth surface 19. The substantially smooth or flat section may be configured to deter the formation or retention of any foreign material including for example and without limitation slag and siliceous. In another illustrative embodiment, the conduction section 16 may comprise one or more indentations or notches, which may be configured to encourage or promote the retention of any foreign material including for example and without limitation slag and siliceous. As seen in FIG. 7, the systems 30, 35, 40 illustratively may include breaks 47 as desired. Any suitable fluid, such as for example and without limitation any gas or liquid, may be directed through the core 22 in order to facilitate heat transfer.

Figure 8:
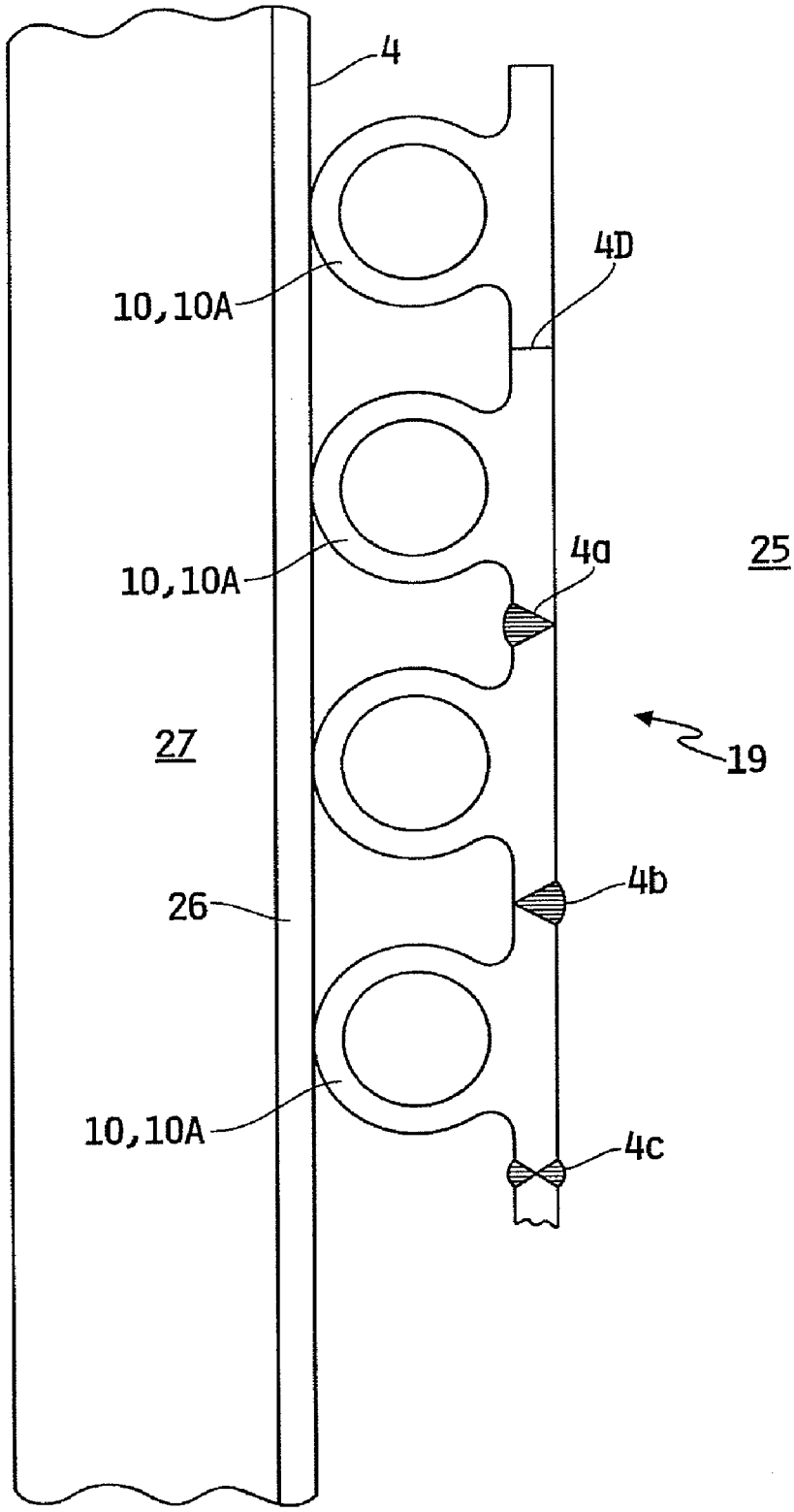
FIG. 8 is a cross-sectional view of a plurality of pipes of FIG. 3 coupled to one another and to a plate, the plate being disposed within a metal processing device.

Illustratively, a heat exchange apparatus 30, 35, 40 may generally consist of one or more of the illustrative pipes 10, 10A, 20, 20A coupled together in any combination as for example and without limitation in a butted configuration next to one another to establish a continuous matrix of notches or indentions 18 that promote slag adhesion to the surface of pipes 10, 10A, and/or to establish a generally smooth, anti adhesion surface 19. As best seen in FIG. 8, the pipes may be coupled using any suitable method including spot welding 4*a*, 4*b*, 4*c* on either or both sides of the conduction portions, or other suitable methods 4*d* known to those skilled in the art. Similarly, the support sections 14 can be attached or coupled to the system's support structure 27 or to the plate 26 using any suitable method, including for example and without limitation welding. The pipes 10, 10A may have a generally planar conduction surface having slag retention notches or indentions 18. Illustratively, the notches or indentions 18 can be for example and without limitation steeped, rectangular, serrated, oval, etc. The thickness of the exposed smooth/ indented surface 18, 19 of the pipe 10, 10A, 20, 20A may be designed to optimize the heat transfer and mechanical requirements of the process. The support portion 14 of the pipe 10, 10A, 20, 20A illustratively may have any suitable geometric configuration including for example and without limitation round, square or obround or otherwise. The tubes/pipe can have any fluid, including for example and without limitation, a liquid such as for example water, or a gas such as for example air directed or flowing through them to create a heat transfer and cooling of the equipment, if needed by the process.

Illustratively, the pipes may be manufactured using any suitable process including being cold rolled, hot rolled, drawn, extruded or cast. Illustratively, the pipes can be manufactured from ferrous metals, steel, copper, steel/ferrous alloy or copper alloys, nickel, titanium, bronze alloys including aluminum-bronze and nickel-bronze alloys, and other suitable materials. The pipes can be seamless or welded in design. Illustratively, for example if the pipes are extruded, the mass on either side of center line 29 is substantially equal. Thus, the walls defined by the inner and outer boundaries 12*a*, 12*b* may have thickened portions on the side containing the support portion 14 in the illustrative embodiments.

While the invention has been illustrated and described in detail in the foregoing drawings and description, the same is to be considered as illustrative and not restrictive in character, it being understood that only illustrative embodiments thereof have been shown and described and that all changes and modifications that come within the spirit of the invention are desired to be protected.

What is claimed is:

1. A heat exchange apparatus mounted within a metallurgy furnace comprising:

an integrally formed unitary monolithic pipe defined by an inner boundary and an outer boundary, the pipe including:

a hollow core defined by the inner boundary and having a core center;

a support portion on the outer boundary, the support portion having a support center and a support length defined by a cumulative distance the support portion extends laterally on either side of the support center;

a generally planar conduction portion formed generally tangentially on the outer boundary generally opposite the support portion and extending generally laterally of the pipe, the conduction portion having a conduction center and a conduction length defined by a cumulative distance the conduction portion extends generally laterally on either side of the conduction center, the conduction length being greater than the support length; and wherein the pipe has a vertical axis extending generally through the core center when viewed in cross section and wherein each of the support portion, the hollow core and the conduction centers are displaced from and generally aligned with one another along the vertical axis; and the support portion and the generally planar conduction portion are the same material; and wherein the support portion is mounted within a metallurgy furnace having an operating portion such that the conduction portion is exposed to the hot metal or gases emanating from the furnace and the conduction portion is disposed facing inwardly toward the operating portion of the furnace and the support portion is coupled to the furnace wall and the support portion is disposed facing outwardly away from the operating portion of the furnace.

2. The heat exchange apparatus of claim 1 wherein the pipe comprises a unitary pipe, the conduction portion being formed integrally with the outer boundary.

3. The heat exchange apparatus of claim 2 wherein the pipe comprises a heavy walled pipe.

4. The heat exchange apparatus of claim 3 wherein the pipe comprises a metallic pipe.

5. The heat exchange apparatus of claim 4 wherein the pipe is manufactured from a metal chosen from the group consisting of a ferrous metal, steel, copper, a steel ferrous alloy, a copper alloy, nickel, titanium, a bronze alloy, an aluminum-bronze alloy, and a nickel-bronze alloy.

6. The heat exchange apparatus of claim 4 wherein the pipe is manufactured from a process chosen from the group consisting of cold rolling, hot rolling, drawing, extruding and casting.

7. The heat exchange apparatus of claim 4 wherein the unitary pipe is extruded.

8. The heat exchange apparatus of claim 7 wherein the support portion comprises a generally planar portion.

9. The heat exchange apparatus of claim 7 wherein the support portion is generally non-planar.

10. The heat exchange apparatus of claim 9 wherein the support portion is arcuate.

11. The heat exchange apparatus of claim 7 wherein the pipe comprises a first half including the conduction portion and having a first mass and a second half including the support portion and having a second mass, the first mass and the second mass being substantially equivalent.

12. The heat exchange apparatus of claim 4 further comprising:

a cooling panel comprising a plurality of the pipe in fluid communication with each other; and wherein the cooling panel is disposed within the metallurgy furnace with the conduction portion of each pipe facing inwardly toward the operating portion of the furnace.

13. The heat exchange apparatus of claim 12 wherein the plurality of pipe is coupled together.

14. The heat exchange apparatus of claim 13 wherein the conduction portion of each of the plurality of pipe includes a pair of opposing protrusions extending from the conduction center and ending in a tip, the tip of each of the opposing protrusions being coupled to the corresponding tip of the adjacent pipe forming a continuous surface.

15. The heat exchange apparatus of claim 12 wherein the supporting portion of each pipe is connected directly to the metallurgical furnace.

16. The heat exchange apparatus of claim 12 wherein the supporting portion of each pipe is connected to a plate and the plate is connected to the furnace.

17. The heat exchange apparatus of claim 12 wherein the conduction portion comprises a substantially flat smooth surface continuous between pipes.

18. The heat exchange apparatus of claim 12 wherein the conduction portion comprises at least one notch.

19. The heat exchange apparatus of claim 12 wherein the conduction portion of at least one pipe comprises a substantially smooth surface and the conduction portion of at least one other pipe comprises at least one notch.

20. A method of cooling the interior wall of a metallurgical furnace comprising the steps of:

forming a plurality of monolithic pipes with each pipe comprising a tubular section, a generally arcuate support portion, and a generally planar conduction portion generally opposed to the support portion; the support portion and the generally planar portion are the same material;

mounting the plurality of monolithic pipes in the metallurgical furnace so that the generally planar conduction portions of the pipes are coupled and disposed facing inwardly toward the operating portion of the furnace so that the generally planar conduction portions of the pipes form a generally planar portion exposed to the hot metal or gases emanating from the furnace and each pipe support portion is coupled to the furnace wall and the support portion is disposed facing outwardly away from the operating portion of the furnace; and directing a cooling fluid through the pipes.

21. The method of cooling of claim 20 wherein the conduction portion of each pipe of the panel comprises a notched surface and further comprising the step of retaining transient matter from the furnace on the conduction portion.

22. The method of cooling of claim 20 wherein the conduction portion of each pipe of the panel comprises a substantially smooth surface and further comprising the step of discouraging the retention of transient matter from the furnace on the substantially smooth conduction surface.

23. The method of cooling of claim 20 wherein at least one pipe of the panel has a substantially smooth conduction portion and at least one pipe of the panel has a notched conduction portion and further comprising the steps of discouraging the retention of transient matter from the furnace on the substantially smooth conduction portion; and retaining transient matter from the furnace on the notched conduction portion.

24. The method of claim 23 further comprising the step of replacing one or more of the pipes.

25. The method of claim 20 wherein the generally planar portion is continuous between pipes.

26. The method of claim 20 wherein the generally planar conduction portion of each of the plurality of pipes includes a pair of opposing protrusions extending from a conduction center and ending in a tip, and further comprising the step of abutting the tip of opposing protrusions and coupling the abutting corresponding tips of adjacent pipe to form a continuous surface.

* * * * *